US009476557B2

(12) United States Patent
Kumar et al.

(10) Patent No.: US 9,476,557 B2
(45) Date of Patent: Oct. 25, 2016

(54) LOW PROFILE HIGHLY EFFICIENT VEHICULAR LED MODULES AND HEADLAMPS

(71) Applicant: Ford Global Technologies, LLC, Dearborn, MI (US)

(72) Inventors: Arun Kumar, Farmington Hills, MI (US); Albert Ekladyous, Shelby Township, MI (US); Mahendra Somasara Dassanayake, Bloomfield Hills, MI (US); Bruce Preston Williams, Grosse Pointe Park, MI (US); Junmo Park, Northville, MI (US); Eric Stoddard, Birmingham, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/551,711

(22) Filed: Nov. 24, 2014

(65) Prior Publication Data

US 2015/0078029 A1 Mar. 19, 2015

Related U.S. Application Data

(63) Continuation-in-part of application No. 13/736,265, filed on Jan. 8, 2013, now Pat. No. 9,156,395.

(51) Int. Cl.
*F21V 5/00* (2015.01)
*F21S 8/10* (2006.01)

(52) U.S. Cl.
CPC ..... *F21S 48/1225* (2013.01); *F21S 48/1154* (2013.01); *F21S 48/1241* (2013.01); *F21S 48/137* (2013.01); *F21S 48/328* (2013.01)

(58) Field of Classification Search
CPC ..... F21S 48/1258; F21S 48/1159; F21S 48/1283; F21V 5/04
USPC ..... 362/487, 509, 520, 522
See application file for complete search history.

(56) References Cited

U.S. PATENT DOCUMENTS 4,389,698 A 6/1983 Cibie
4,864,473 A 9/1989 Tokarz et al.
(Continued)

FOREIGN PATENT DOCUMENTS

DE 102006051029 A1 7/2007
DE 102011078653 B4 12/2013
(Continued)

OTHER PUBLICATIONS

SAE International. Printed Jan. 7, 2013. "Construction and Application of Near Field (TIR Type) lenses for Automotive Lighting Functions." http://papers.sae.org/2007-01-1040/.
(Continued)

*Primary Examiner* — Andrew Coughlin
*Assistant Examiner* — Meghan Ulanday
(74) *Attorney, Agent, or Firm* — Jason Rogers; Price Heneveld LLP

(57) ABSTRACT

A vehicle headlamp module is provided that includes a lens having a plurality of near-field lens elements, a canted input surface, an exit surface and a cavity between the surfaces. The headlamp module also includes an LED lighting module that directs incident light through the input and exit surfaces. The lens elements are configured to transmit from the exit surface a collimated light pattern containing at least 60% of the incident light. In some embodiments, the exit surface includes a step-wise pattern of optical elements. In other implementations, a headlamp assembly is provided that includes a plurality of vehicle headlamp modules. Each headlamp module includes: a lens with a canted input surface and an exit surface, a bezel surrounding the lens, and an LED light source that directs incident light through the input surface. The lens of each module includes a plurality of near-field lens elements.

20 Claims, 9 Drawing Sheets

(56) References Cited

U.S. PATENT DOCUMENTS

| | | | | |
|---|---|---|---|---|
| 4,928,212 | A | 5/1990 | Benavides | |
| 6,004,014 | A | 12/1999 | Yamamura et al. | |
| 6,244,731 | B1 * | 6/2001 | Koiko | F21S 48/1233 362/268 |
| 6,441,943 | B1 | 8/2002 | Roberts et al. | |
| 6,926,972 | B2 | 8/2005 | Jakobi et al. | |
| 6,951,416 | B2 | 10/2005 | Sazuka et al. | |
| 7,410,282 | B2 | 8/2008 | Eichelberger et al. | |
| 7,658,866 | B2 | 2/2010 | Murazaki et al. | |
| 7,815,350 | B2 | 10/2010 | Valcamp et al. | |
| 8,104,939 | B2 | 1/2012 | Coushaine et al. | |
| 8,469,565 | B2 | 6/2013 | Yatsuda et al. | |
| 8,545,723 | B2 | 10/2013 | Comanzo et al. | |
| 2004/0213001 | A1 | 10/2004 | Sayers et al. | |
| 2005/0190570 | A1 | 9/2005 | Roessler | |
| 2007/0236956 | A1 | 10/2007 | Kolodin et al. | |
| 2008/0304277 | A1 | 12/2008 | Chinniah et al. | |
| 2009/0213608 | A1 * | 8/2009 | Mozaffari-Afshar | F21S 48/1258 362/520 |
| 2011/0169410 | A1 | 7/2011 | Dassanayake et al. | |
| 2011/0205748 | A1 | 8/2011 | Yatsuda | |
| 2012/0038272 | A1 | 2/2012 | De Castro | |
| 2014/0098517 | A1 | 4/2014 | Chen | |
| 2014/0192547 | A1 | 7/2014 | Kumar et al. | |

FOREIGN PATENT DOCUMENTS

| | | | |
|---|---|---|---|
| JP | H02129802 | A | 5/1990 |
| JP | H04324201 | A | 11/1992 |
| JP | 2000173318 | A | 6/2000 |
| JP | 2011165441 | A | 8/2011 |
| JP | 2012243727 | A | 12/2012 |
| WO | 2007088157 | A1 | 8/2007 |

OTHER PUBLICATIONS

Oliver Dross, Aleksandra Cvetkovic, Julio Chaves, Pablo Benitez, and Juan C. Miñano; "LED Headlight Architecture that creates a High Quality Beam Pattern independent of LED Shortcomings," pp. 1-10, Proc. SPIE 5942, Nonimaging Optics and Efficient Illumination Systems II, 59420D, (Published Aug. 22, 2005).

Turkish Patent Institute, Transmittal of the 1st Examination Report in TR Patent Application No. 2013/14907 dated Jul. 3, 2015 re: Austrian Patent Office Examination Report dated Jun. 29, 2015, 6 pages.

* cited by examiner

LOW PROFILE HIGHLY EFFICIENT VEHICULAR LED MODULES AND HEADLAMPS

CROSS-REFERENCE TO RELATED APPLICATION

This application is a continuation-in-part under 35 U.S.C. §120 of prior U.S. patent application Ser. No. 13/736,265, filed on Jan. 8, 2013, now U.S. Pat. No. 9,156,395, entitled "LOW PROFILE HIGHLY EFFICIENT VEHICULAR LED MODULES AND HEADLAMPS," the entire disclosure of which is hereby incorporated by reference in its entirety.

FIELD OF THE INVENTION

The present invention generally relates to lighting modules and assemblies and, more particularly, to vehicular headlamp modules and assemblies.

BACKGROUND OF THE INVENTION

Conventional vehicle headlamps employ multiple components (e.g., a light source, collector, and light distributor). These headlamps are also subject to dimensional constraints associated with the lens shapes necessary to produce the required light output pattern (e.g., low-beam headlamp pattern, high-beam headlamp pattern, etc.). Light transmission efficiency is also a problem as conventional vehicular headlamps do not exceed 50% efficiency. Accordingly, these headlamps require significant energy usage. Hence, conventional headlamp options with a low profile and high light transmission efficiency are not available.

Conventional vehicle headlamp assemblies also can suffer a reduction in light transmission efficiency when integrated into the aesthetic and/or aerodynamic aspects of vehicle designs. For example, many vehicles require headlamp assemblies to sweep or curve in an upward and vehicle-rearward fashion along the driver and passenger side of the vehicle. Consequently, the exit surfaces of these headlamp assemblies often require some curvature and orientation that can interfere with efficient light transmission.

Vehicle headlamp components, modules and assemblies with high transmission efficiency and design shape flexibility are therefore desirable to address these problems. In addition, improvements in light transmission efficiency can be manifested in better packaging efficiency through smaller vehicle headlamp designs.

SUMMARY OF THE INVENTION

According to one aspect of the present invention, a vehicle headlamp module is provided that includes a lens having a plurality of near-field lens elements, a canted input surface, an exit surface and a cavity between the surfaces. The headlamp module also includes an LED lighting module that directs incident light through the input and exit surfaces. The lens elements are configured to transmit from the exit surface a collimated light pattern containing at least 60% of the incident light.

According to another aspect of the present invention, a vehicle headlamp module is provided that includes a plurality of near-field lens elements, an input surface, an exit surface having a step-wise pattern of optical elements, and a cavity between the surfaces. The headlamp module also includes an LED light source that directs incident light through the input and exit surfaces. The lens elements are configured to transmit a collimated light pattern from the exit surface containing at least 60% of the incident light.

According to an additional aspect of the present invention, a vehicle headlamp assembly is provided that includes a plurality of vehicle headlamp modules. Each headlamp module includes: a lens with a canted input surface and an exit surface, a bezel surrounding the lens, and an LED light source that directs incident light through the input surface. The lens of each module includes a plurality of near-field lens elements that are configured to transmit at least 60% of the incident light in a collimated, vehicular light pattern.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
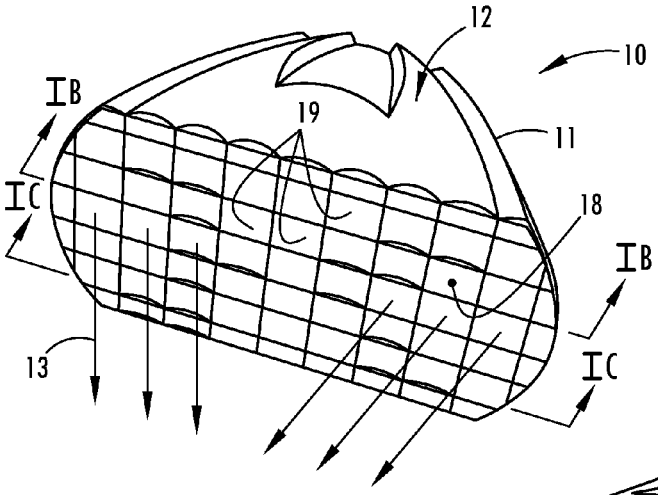
FIG. 1 is a front, perspective view of a vehicle lighting module with a lens having a substantially rectangular exit surface according to one aspect of this disclosure.

For purposes of description herein, the terms "upper," "lower," "right," "left," "rear," "front," "vertical," "horizontal," and derivatives thereof shall relate to the invention as oriented in FIG. 1. However, the invention may assume various alternative orientations, except where expressly specified to the contrary. Also, the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1A:
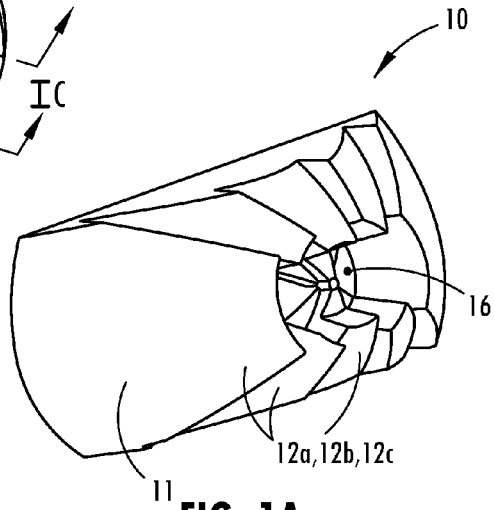
FIG. 1A a rear, perspective view of the vehicle lighting module depicted in FIG. 1.
Figure 1B:
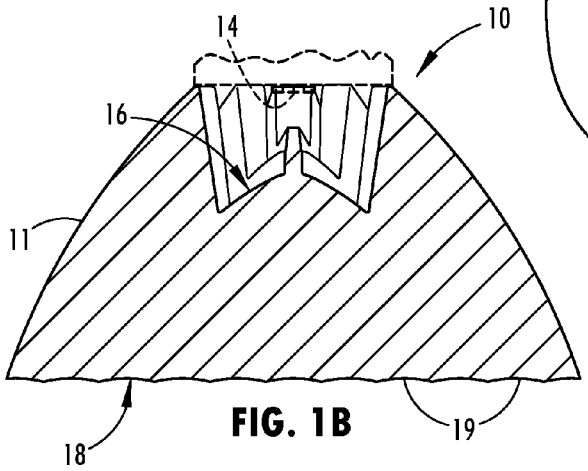
FIG. 1B is a cross-sectional view of the vehicle lighting module depicted in FIG. 1 at line IB-IB.
Figure 1C:
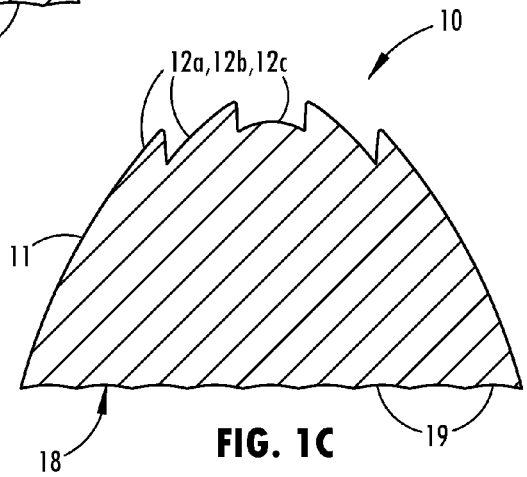
FIG. 1C is a cross-sectional view of the vehicle lighting module depicted in FIG. 1 at line IC-IC.

FIGS. 1-1C depict a vehicle lighting module 10 with a lens 11 according to one aspect of the invention. Lens 11 includes multiple near-field lens elements 12, an input surface 16 (see FIG. 1A) and exit surface 18 (see FIG. 1). As shown, the exit surface 18 of lens 11 may be substantially rectangular in shape, and the input surface 16 substantially circular in shape. Further, the exterior walls of lens 11 may be shaped to accommodate the shape of input surface 16 and exit surface 18. In addition, the lens 11 may be fabricated from an optically translucent material, such as polycarbonate, glass, or other translucent materials with high optical quality and capable of being manufactured to tight tolerances. Near-field lens elements 12, input surface 16 and exit surface 18 are integrated within lens 11. Accordingly, lens 11 is typically fabricated from one piece of material.

Figure 2:
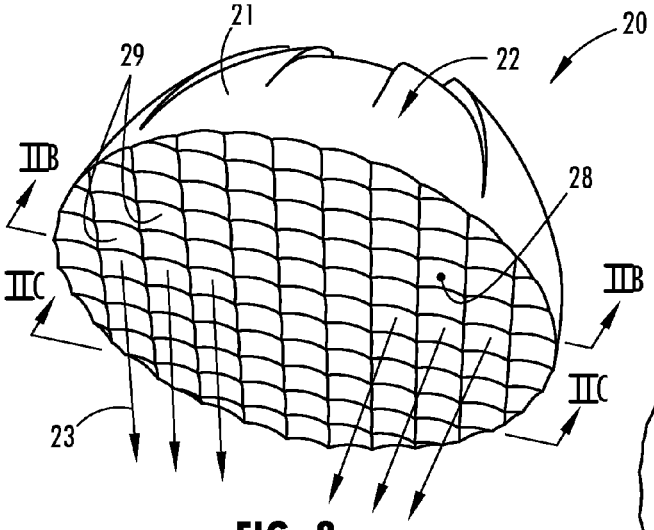
FIG. 2 is a front, perspective view of a vehicle lighting module with a lens having a substantially circular exit surface according to another aspect of this disclosure.
Figure 2A:
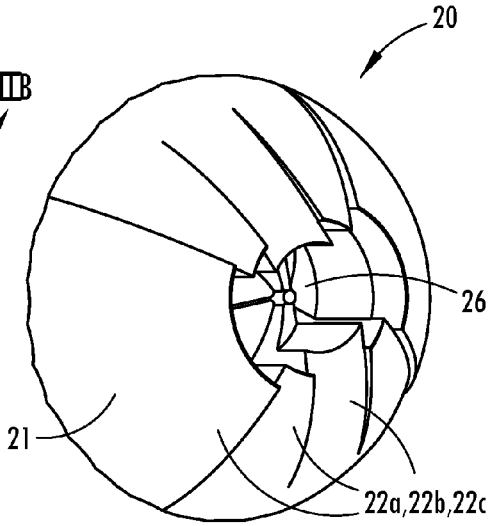
FIG. 2A is a rear, perspective view of the vehicle lighting module depicted in FIG. 2.
Figure 2B:
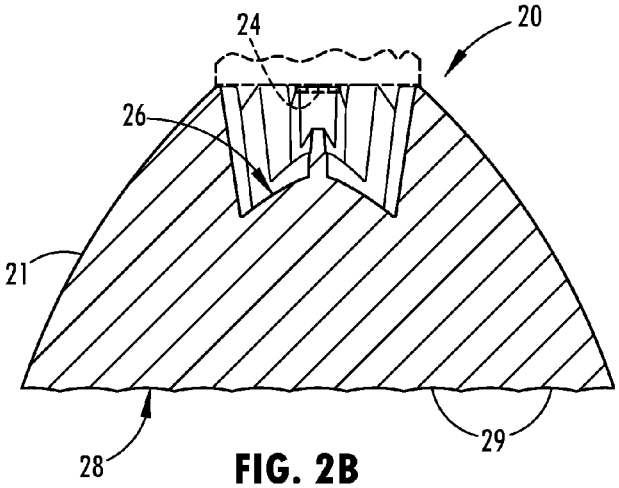
FIG. 2B is a cross-sectional view of the vehicle lighting module depicted in FIG. 2 at line IIB-IIB.
Figure 2C:
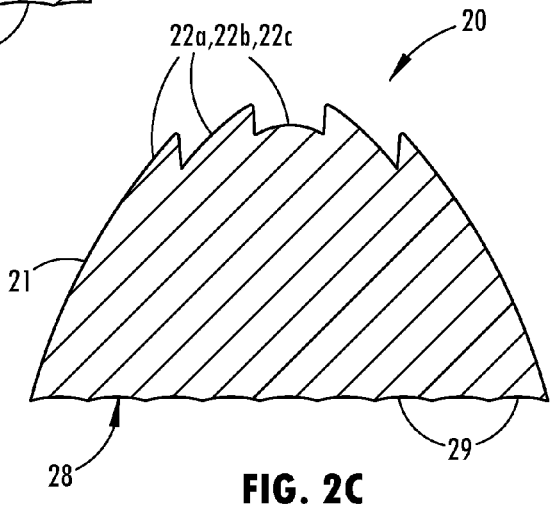
FIG. 2C is a cross-sectional view of the vehicle lighting module depicted in FIG. 2 at line IIC-IIC.

FIGS. 2-2C depict a vehicle lighting module 20 with a lens 21 according to another aspect of the invention. Lens 21 includes multiple near-field lens elements 22, an input surface 26 (see FIG. 2A) and exit surface 28 (see FIG. 2). As shown, the exit surface 28 of lens 21 may be substantially circular in shape, and the input surface 26 substantially circular in shape. The exterior walls of lens 21 may also be shaped to accommodate the substantially circular input and exit surfaces 26 and 28, respectively. Further, lens 21 may be fabricated from an optically translucent material, such as polycarbonate, glass, or other translucent materials with high optical quality and capable of being manufactured to tight tolerances. Near-field lens elements 22, input surface 26 and exit surface 28 are integrated within lens 21. Accordingly, lens 21 can be fabricated from one piece of material.

Both vehicle lighting modules 10, 20 include a light-emitting diode (LED) light source 14, 24 (see FIGS. 1B, 2B) that directs incident light through the input surface 16, 26 and out of the exit surface 18, 28. LED light source 14, 24 may be selected from various LED lighting technologies, including those that emanate light of wavelengths other than white. As shown in FIGS. 1B and 2B, LED light source 14, 24 may be mounted or otherwise coupled to lens 11, 21 at a position in proximity to the input surface 16, 26, respectively. Accordingly, incident light from LED 14, 24 is directed through input surface 16, 26.

As further shown in FIGS. 1-1C & 2-2C, the plurality of near-field lens elements 12, 22 are configured to transmit from the exit surface 18, 28 of lens 11, 21 a collimated light pattern 13, 23 containing at least 60% of the incident light from LED light source 14, 24. There are relatively few aspects of vehicle lighting modules 10, 20 that lead to loss of light intensity. The incident light from LED source 14, 24 is directed immediately into input surface 16, 26. Thereafter, the light is redirected and collimated by the plurality of near-field lens elements 12, 22 (e.g. lens elements 12*a*-12*c* and 22*a*-22*c* depicted in FIGS. 1A, 1C, 2A and 2C) within lens 11, 21. Accordingly, the input surface 16, 26 can include near-field lens elements 12, 22 (e.g. lens elements 12*a*-12*c*, 22*a*-22*c*) as shown in FIGS. 1A and 2A. There are no other surfaces that reflect the incident light—a process that usually results in 10-20% loss in light intensity. Hence, the overall light transmission efficiency of vehicle lighting modules 10, 20 exceeds 60%.

The near-field elements 12, 22 of vehicle lighting modules 10, 20 are also employed to collimate the incident light from LED light sources 14, 24. Incident light from LED light source 14, 24 is usually Lambertian in character with significant scattering in various directions. In other words, light emanates and spreads from the source in all directions—on the order of 180 degrees. The near-field lens elements 12, 22 are integrated within lens 11, 21 and function to collimate the incident light from LED light source 14, 24. Each lens element 12, 22 may possess a focal length that differs from the focal lengths of other lens elements 12, 22. As such, these lens elements 12, 22 can work together to collimate the incident light from sources 14, 24. Collimation to levels below 10 degrees is feasible with these designs for lens 11, 21 and lens elements 12, 22.

As also shown in FIGS. 1-1C and 2-2C, vehicle lighting modules 10 and 20 may include a plurality of optical elements 19, 29 along the exit surface 18, 28 of lens 11, 21. Optical elements 19, 29 are configured to shape the collimated light pattern 13, 23 into a particular shape depending on the application of lighting module 10, 20. For example, optical elements 19, 29 can be configured to shape a light pattern suitable for use as a low-beam headlamp, i.e., a wide pattern directed relatively close to the vehicle lighting module 10, 20 when it is arranged in a vehicle headlamp application. As another example, optical elements 19, 29 can be configured to shape a light pattern 13, 23 suitable for use as a high-beam headlamp, i.e., a narrow pattern directed farther away from the vehicle than a low-beam headlamp. Still further, optical elements 19, 29 can be configured within vehicle lighting modules 10, 20 to shape a light pattern 13, 23 into a fog, low-beam, high-beam, static bending and/or daytime running lamps.

Vehicle lighting modules 10, 20 can be optimized in view of the potential trade-offs between light transmission efficiency and degree of collimation. For example, a design of lens 11, 21 with a single near-field lens element 12, 22 having a rectangular aperture (e.g., a rectangular-shaped exit surface 19) generally exhibits lower transmission efficiency (e.g., 50% or less). This is particularly the case for non-circular lens elements, such as near-field lens elements 12. On the other hand, a single near-field lens element can collimate, in some aspects, incident light with a Lambertian character from an LED light source 14 down to approximately 3 degrees, depending on the size of the LED source 14 and other considerations (e.g., the refractive index of the lens 11, 21).

While a large degree of collimation is beneficial, particularly for high-beam headlamp applications, it can be advantageous to design the lenses 11, 21 with a plurality of lens elements 12, 22 to increase light transmission efficiency. Preferably, three or more near-field lens elements 12, 22 are integrated within lens 11, 21 to achieve light transmission efficiencies on the order of 65% or better with collimation levels down to 5 degrees or less. Nevertheless, certain applications do not require the degree of collimation necessary for a vehicular headlamp application. Fog lamp and daytime running light applications, for example, only require collimation from 6 to 8 degrees and less than 10 degrees, respectively. Accordingly, more near-field lens elements 12, 22 can be configured within lighting modules 10, 20 when they are employed in these less-directional applications (i.e., fog and daytime running lamps) to further increase light transmission efficiency.

The use of a plurality of near-field lens elements 12, 22 in vehicle lighting modules 10, 20 provides a large degree of design flexibility, particularly for low-profile configurations. Lighting modules having lenses with non-circularly shaped exit surfaces generally suffer from a significant loss in transmission efficiency. Here, the multiple lens elements 12, 22 integrated within lens 11, 21 (often with varying focal lengths) significantly improves the light transmission efficiency of the lighting modules 10, 20 without significant sacrifice to the degree of collimation needed for the application, such as vehicular headlamp applications. Consequently, low-profile designs of modules 10, 20 (i.e., low aspect ratios of height to width) are feasible.

Still further, the use of a single-piece design for lens 11, 21 with integrated, near-field lens elements 12, 22 results in modules 10, 20 having shorter depth profiles (in the direction from the exit surfaces 18, 28 to the input surfaces 16, 26). LED light sources 14, 24 need only be mounted in a recessed portion of lens 11, 21, not separated from input surfaces 16, 26 by any additional components. In preferred configurations of modules 10, 20, the depth profile is approximately 50 mm or less from the exit surfaces 18, 28 to the LED light sources 14, 24; the width is approximately 80 to 90 mm and the height is approximately 40 to 45 mm. Even more preferably, the depth profile of modules 10, 20 is approximately 25 mm or less; the width is approximately 80 to 90 mm and the height is approximately 20 to 25 mm. It should be understood, however, that other low profile configurations for modules 10, 20 are viable with dimensions that vary from the foregoing exemplary configuration.

Figure 3:
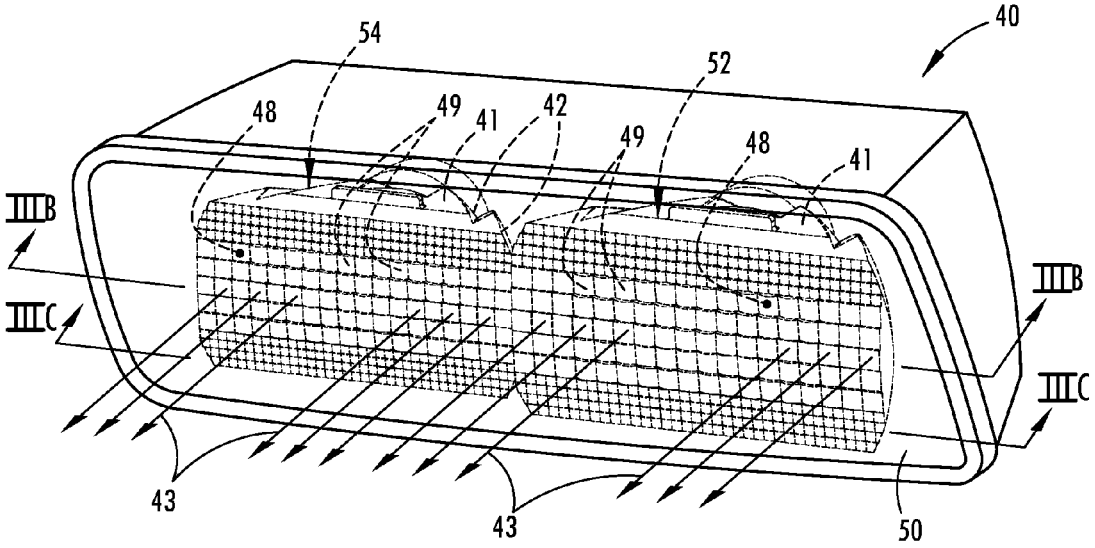
FIG. 3 is a front, perspective view of a vehicle headlamp assembly that includes a pair of vehicle lighting modules with substantially rectangular exit surfaces according to a further aspect of this disclosure.
Figure 3A:
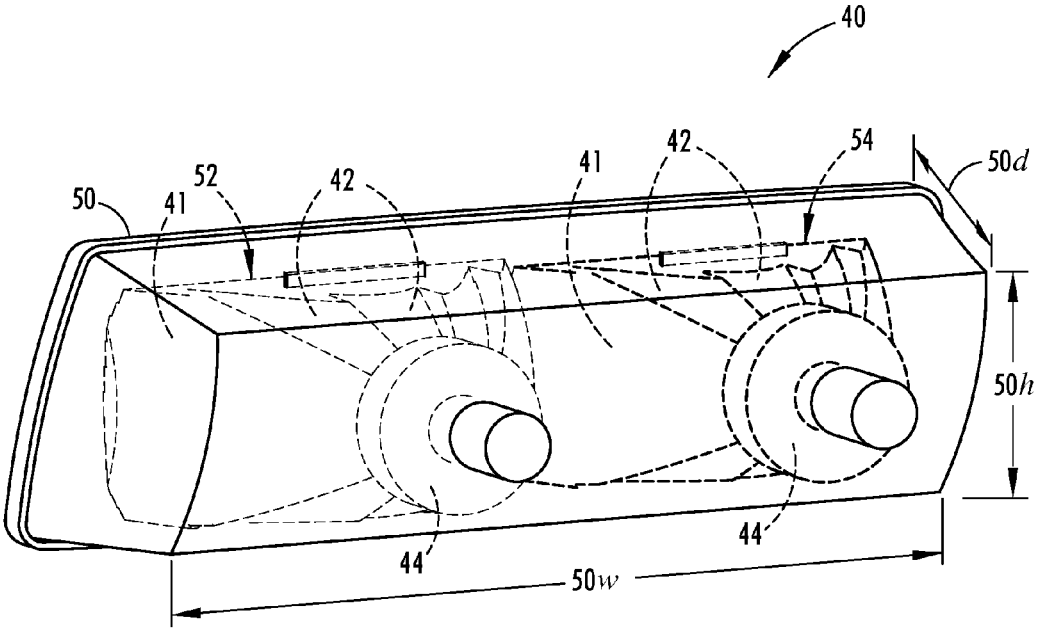
FIG. 3A is a rear, perspective view of the vehicle headlamp assembly depicted in FIG. 3.
Figure 3B:
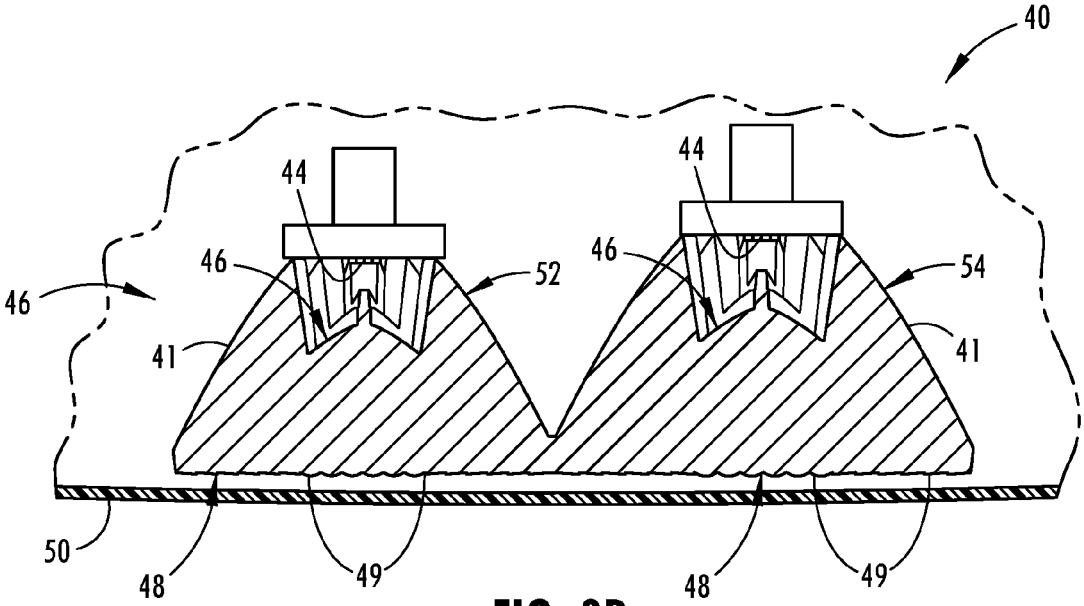
FIG. 3B is a cross-sectional view of the vehicle headlamp assembly depicted in FIG. 3 at line IIIB-IIIB.
Figure 3C:
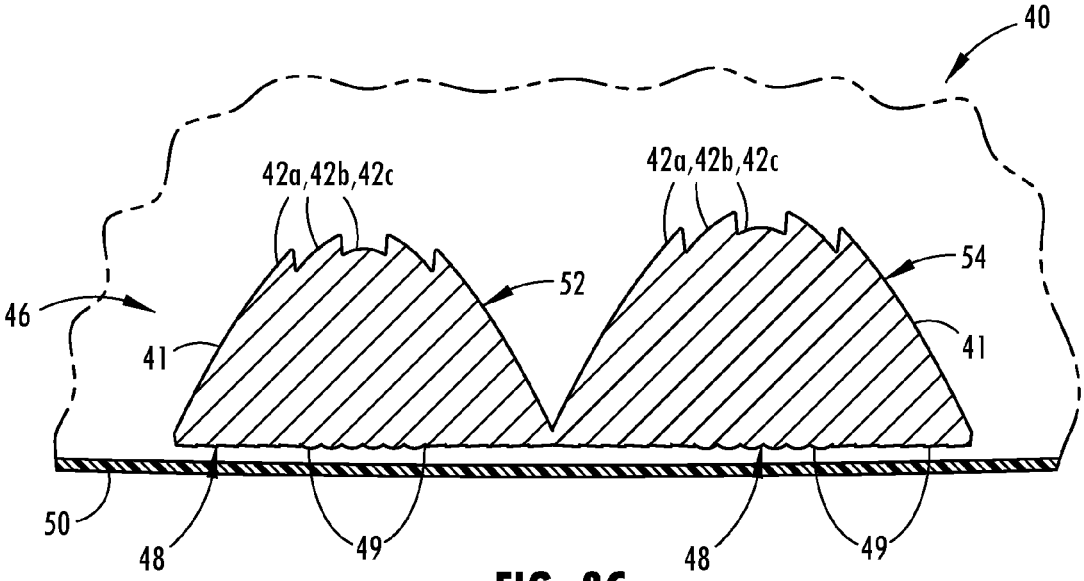
FIG. 3C is a cross-sectional view of the vehicle headlamp assembly depicted in FIG. 3 at line IIIC-IIIC.

Referring to FIGS. 3-3C, a vehicle headlamp assembly 40 is depicted according to a further aspect of the invention with a pair of adjacent lighting modules 52, 54. Modules 52, 54 may be configured for low beam and high beam headlamp applications. Each module 52, 54 includes a lens 41, and an LED light source 44 that directs incident light from light source 44 through lens 41. As shown, the exit surface 48 of lens 41 is substantially rectangular in shape, whereas the input surface 46 is substantially circular in shape. In addition, each lens 41 includes a plurality of near-field lens elements 42. These near-field lens elements 42 are configured to transmit from the exit surface 48 of lens 41 a collimated light pattern 43 containing at least 60% of the incident light from LED light source 44. It should be understood that the low beam and high beam lighting modules 52 and 54 employed by vehicle headlamp assembly 40 operate and can be configured in a fashion similar to the vehicle lighting module 10 depicted in FIGS. 1-1C (e.g., lens 41 may possess three near-field lens elements 42*a*, 42*b* and 42*c* with differing focal lengths as shown in FIG. 3C).

Figure 4:
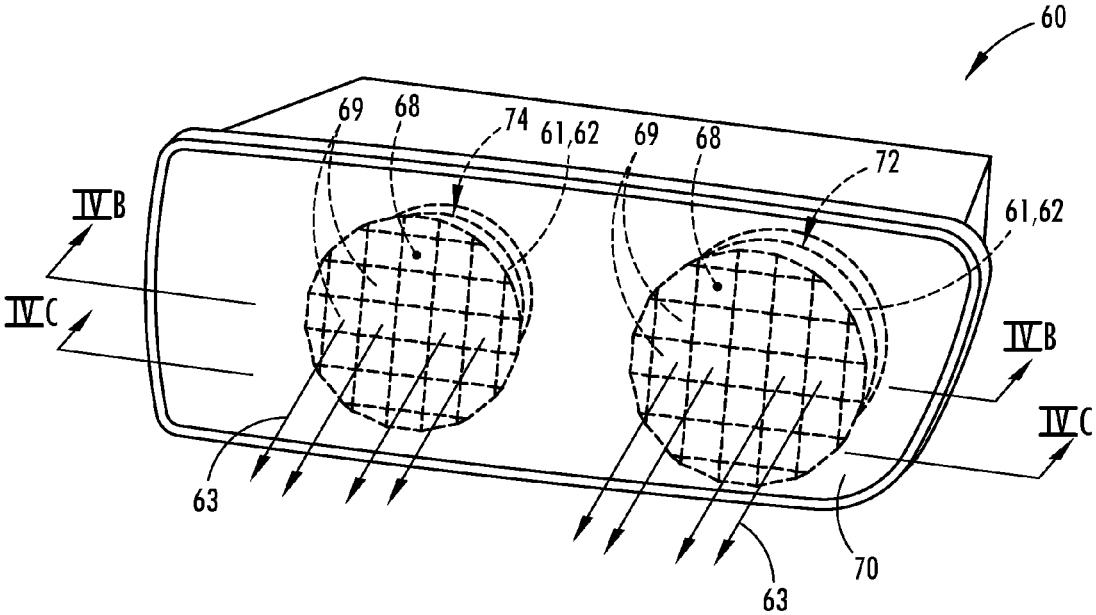
FIG. 4 is a front, perspective view of a vehicle headlamp assembly that includes a pair of vehicle lighting modules with substantially circular exit surfaces according to a further aspect of this disclosure.
Figure 4A:
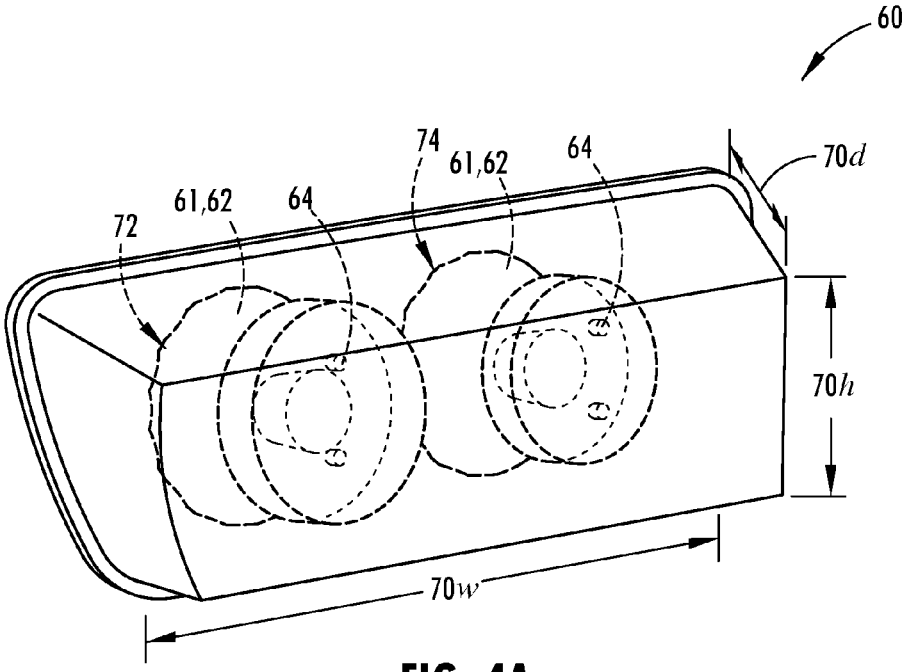
FIG. 4A is a rear, perspective view of the vehicle headlamp assembly depicted in FIG. 4.
Figure 4B:
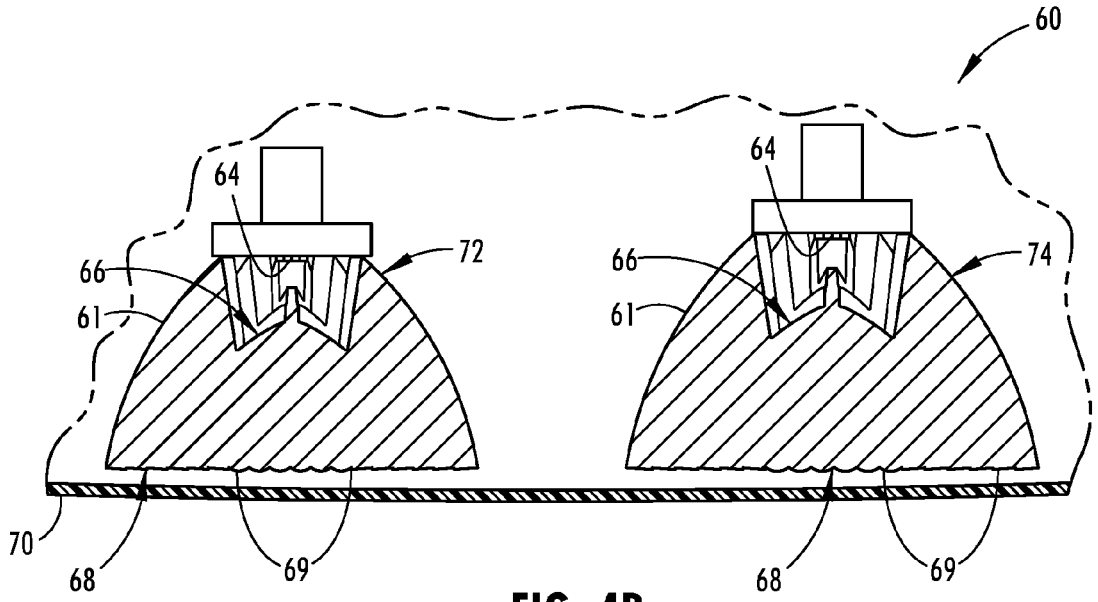
FIG. 4B is a cross-sectional view of the vehicle headlamp assembly depicted in FIG. 4 at line IVB-IVB.
Figure 4C:
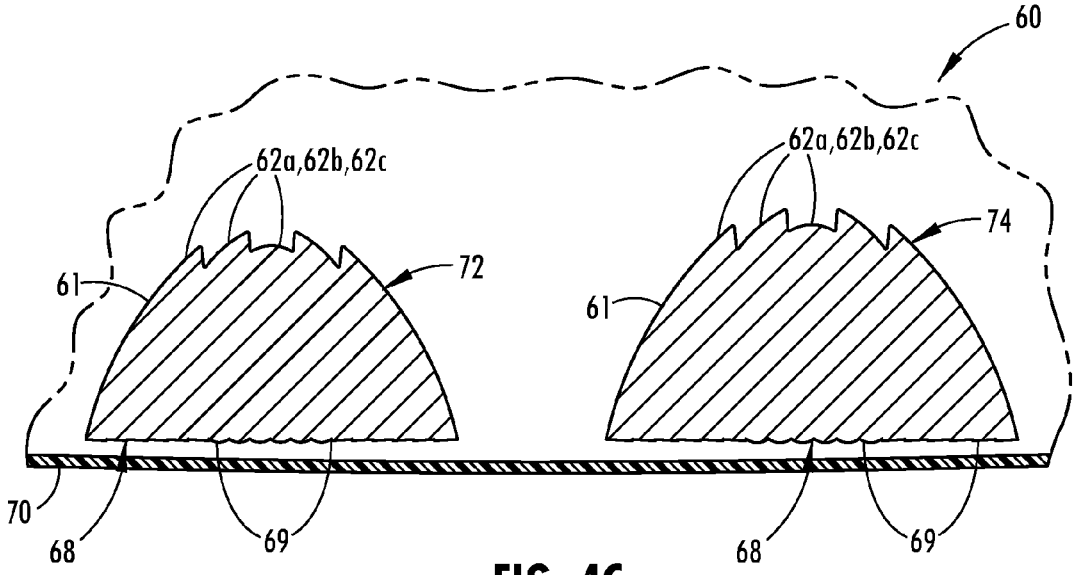
FIG. 4C is a cross-sectional view of the vehicle headlamp assembly depicted in FIG. 4 at line IVC-IVC.

Likewise, a vehicle headlamp assembly 60 is depicted according to another aspect of the invention with a pair of adjacent lighting modules 72, 74, respectively, as shown in FIGS. 4-4C. Modules 72, 74 may also be configured for low beam and high beam headlamp applications. Here, each module 72, 74 includes a lens 61, and an LED light source 64 that directs incident light from light source 64 through lens 61. The exit surface 68 of lens 61 is substantially circular in shape, comparable to input surface 66, also substantially circular in shape. In addition, each lens 61 includes a plurality of near-field lens elements 62 (comparable to lens elements 42—see FIGS. 3-3C). These near-field lens elements 62 are configured to transmit from the exit surface 68 of lens 61 a collimated light pattern 63 containing at least 60% of the incident light from LED light source 64. In addition, the low beam and high beam lighting modules 72 and 74 employed by vehicle headlamp assembly 60 can be configured and may operate in a fashion similar to the vehicle lighting module 20 depicted in FIGS. 2-2C (e.g., lens 61 may possess three near-field lens elements 62*a*, 62*b* and 62*c* with differing focal lengths as shown in FIG. 4C).

As further depicted in FIGS. 3, 3A and 4, 4A, headlamp assemblies 40, 60 include a case 50, 70 for housing the lighting modules 52, 54, and 72, 74, respectively. The case 50, 70 may be configured in a substantially rectangular cuboid shape, defined by a width, 50*w*, 70*w*; height, 50*h*, 70*h*; and depth, 50*d*, 70*d*. The case 50, 70 may be fabricated from various materials as known in the automotive field; however, the surface defined by the width (50*w*, 70*w*) and height (50*h*, 70*h*) of the case 50, 70 should be translucent to allow the collimated light pattern 43, 63 to exit the case according to its intended function (e.g., a collimated low-beam headlamp pattern, a high-beam headlamp pattern, etc.).

FIGS. 3-3C and 4-4C also depict vehicle headlamp assemblies 40 and 60 with lighting modules 52, 54 and 72, 74 that include a plurality of optical elements 49, 69 along the exit surface 48, 68 of lens 41, 61. Optical elements 49, 69 are configured to shape the collimated light pattern 43, 63 into a particular shape—e.g., low-beam or high-beam headlamp patterns. Still further, optical elements 49, 69 can be configured within vehicle lighting modules 52, 54 and 72, 74 to shape a light pattern 43, 63 into a fog, low-beam, high-beam, static bending and/or daytime running lamps, depending on the desired application. Preferably, these cases 50, 70 are dimensioned, and the modules 52, 54 and 72, 74 configured, such that the height-to-width aspect ratio of the case is approximately 1:8. Even more preferably, the height-to-width ratio is approximately 1:4 for the cases 50, 70. In addition, cases 50, 70 may have the following dimensions: height 50*h*, 70*h* of approximately 20 to 55 mm; width 50*w*, 70*w* of approximately 150 to 200 mm; and depth 50*d*, 70*d* of approximately 20 to 55 mm.

The foregoing embodiments are exemplary. Other configurations are viable according to the invention. For example, lens 11, 21 employed in modules 10, 20 can possess a near-field lens element composite 12, 22 with continuously varying focal lengths. Such a configuration is comparable to a plurality of near-field lens elements. As another example, the exit surfaces 18, 28 of lens 11, 21 may be characterized by various shapes, provided that they can accommodate a plurality of near-field lens elements 12, 22. It should also be understood that headlamp assemblies 40, 60 can possess various quantities and shapes of lighting modules 52, 54, 72, 74, according to the desired headlamp functionality. For instance, headlamp assemblies 40, 60 may possess multiple, low profile lighting modules 52, 54, 72 and/or 74 for a given lighting or signaling function (e.g., a low-beam function with two lighting modules 52). Accordingly, the headlamp assemblies 40, 60 could contain two sets of lighting modules, each designated for low-beam and high-beam functionality.

Figure 5:
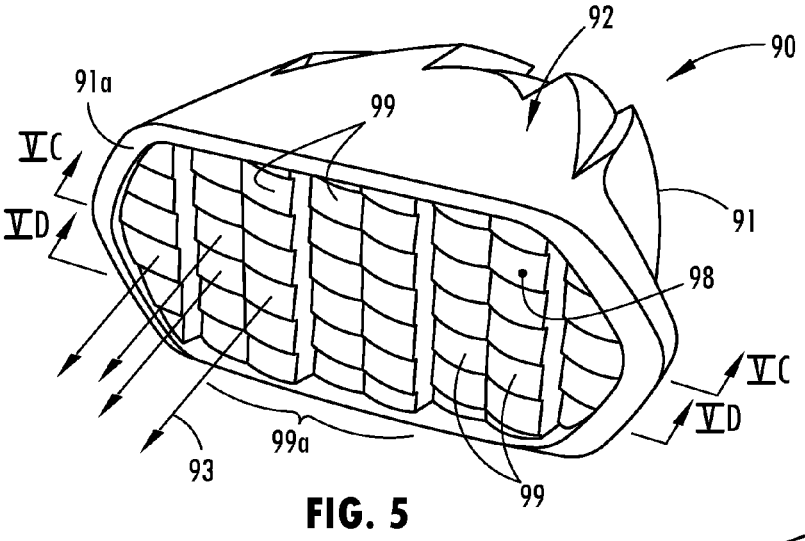
FIG. 5 is a front, perspective view of a vehicle headlamp module with a lens having a substantially hexagonal exit surface according to an additional aspect of this disclosure.
Figure 5A:
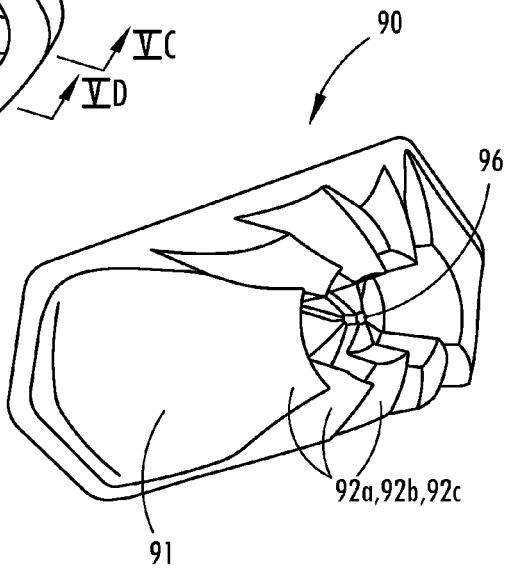
FIG. 5A is a rear, perspective view of the vehicle headlamp module depicted in FIG. 5.
Figure 5B:
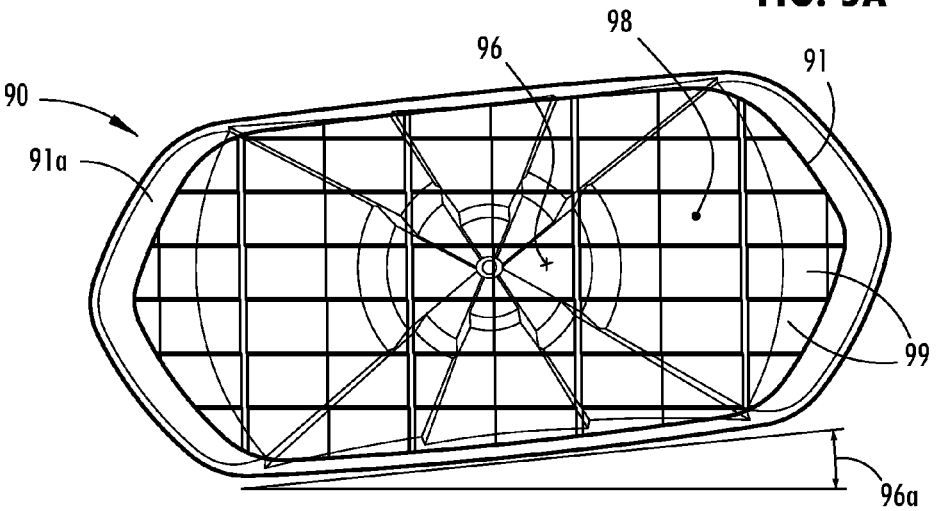
FIG. 5B is a front, end-on view of the vehicle headlamp module depicted in FIG. 5.
Figure 5C:
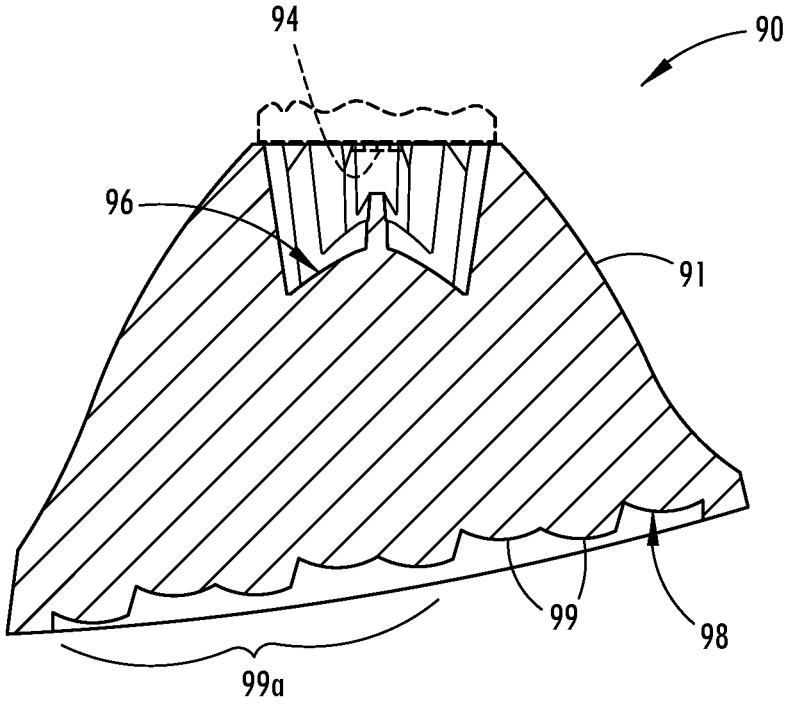
FIG. 5C is a cross-sectional view of the vehicle headlamp module depicted in FIG. 5 at line VC-VC.
Figure 5D:
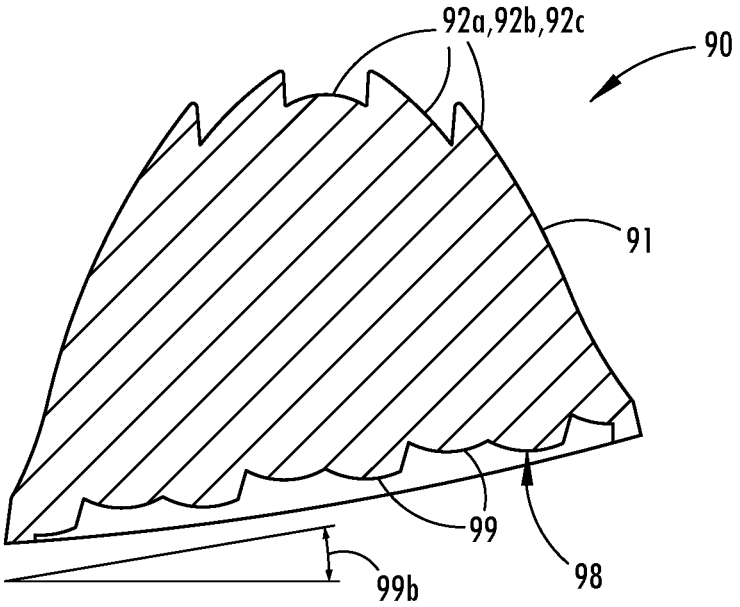
FIG. 5D is a cross-sectional view of the vehicle headlamp module depicted in FIG. 5 at line VD-VD.

In another embodiment, FIGS. 5-5D depict a vehicle headlamp module 90 with a lens 91. Lens 91 includes multiple near-field lens elements 92, an input surface 96 (see FIG. 5A) and exit surface 98 (see FIG. 5). As shown in these figures, the exit surface 98 of lens 91 of vehicle headlamp module 90 is substantially hexagonal in shape, and the input surface 96 substantially circular in shape. It should also be understood that other shapes and configurations of exit surface 98 are feasible, including the shapes exemplified in the foregoing other embodiments of this disclosure.

Referring again to the vehicle headlamp module 90 depicted in FIGS. 5-5D, the exterior walls of lens 91 may define a bezel 91*a*, depicted in an exemplary manner with a substantially hexagonal shape. The bezel 91*a* may be shaped to accommodate the shape of input surface 96 and exit surface 98. In addition, the lens 91 may be fabricated from an optically translucent material, such as polycarbonate, glass, or other translucent materials with high optical quality and capable of being manufactured to tight tolerances. Near-field lens elements 92, input surface 96 and exit surface 98 are integrated within lens 91. Advantageously, bezel 91*a* may also be integrated into the lens 91 and can comprise an optically translucent material, such as polycarbonate, glass or other translucent materials. Accordingly, lens 91 and bezel 91*a* can be typically fabricated from one piece of material. Because the vehicle headlamp module 90 has high light transmission efficiency above 50%, the bezel 91*a* can also comprise materials with low or moderate translucency and, in some aspects, materials that are substantially opaque. As such, bezel 91*a* may be fabricated as a separate piece apart from the lens 91 and later coupled to the lens 91 during assembly of the vehicle headlamp module 90.

Vehicle headlamp module 90 includes an LED light source 94 (see FIG. 5C) that directs incident light through the input surface 96 and out of the exit surface 98. LED light source 94 may be selected from various LED lighting technologies, including those that emanate light of wavelengths other than white. As shown in FIG. 5C, LED light source 94 may be mounted or otherwise coupled to lens 91 at a position in proximity to the input surface 96. The particular position selected for the LED light source 94 relative to the input surface 96 can be optimized to ensure that beam spread for the particular LED employed as the light source 94 is efficiently captured by the input surface 96 with little or no loss of light rays that do not impinge on the input surface 96. Accordingly, incident light from LED light source 94 is at least substantially directed through input surface 96.

As further shown in FIGS. 5-5D, the plurality of near-field lens elements 92 of vehicle headlamp module 90 is configured to transmit from the exit surface 98 of lens 91 a collimated light pattern 93 containing at least 60% of the incident light from LED light source 94. Compared to conventional vehicle headlamp designs, there are relatively few aspects of vehicle headlamp module 90 that leads to a loss of light intensity. The incident light from LED light source 94 is directed immediately into input surface 96. Referring to FIG. 5A, input surface 96 can be arranged in a stepped configuration that is divided into multiple curved surfaces, each of which has a curvature or shape that corresponds to one of the plurality of near-field lens elements 92. As such, the light that originates from the source 94 is redirected or refracted by the input surface 96 (and, more specifically, by each of the surfaces that correspond to the near-field lens elements 92). The light that originated from source 94, now within the lens 91, is then collimated by a plurality of interior, parabolic surfaces of the plurality of near-field lens elements 92 (e.g., lens elements 92*a*-92*c* depicted in FIGS. 5A and 5C) within lens 91. Accordingly, the input surface 96 can include near-field lens elements 92 (e.g., lens elements 92*a*-92*c*) as shown in FIG. 5A. Each of the plurality of interior, parabolic surfaces of the lens 91 corresponds to one of the plurality of near-field lens elements 92. The collimated light within lens 91 now exits the lens 91 through its exit surface 98. As such, there are no other surfaces within the headlamp module 90 that reflects the incident light from source 94—a process that usually results in 10-20% loss in light intensity. Hence, the overall light transmission efficiency of vehicle headlamp module 90 exceeds 60%.

As described earlier, the near-field elements 92 of vehicle headlamp module 90 can be employed to collimate the incident light from LED light source 94. Incident light from LED light source 94 is usually Lambertian in character with significant scattering in various directions. In other words, light emanates and spreads from the source 94 in all directions—on the order of 180 degrees. The near-field lens elements 92 are integrated within lens 91 and function to collimate the incident light from LED light source 94. Each of the plurality of near-field lens element 92 may possess a focal length that differs from the focal lengths of other lens elements 92. As such, these lens elements 92 can work together to collimate the incident light from sources 94. Collimation to levels below 10 degrees is feasible with these designs for lens 91 and lens elements 92.

As also shown in FIGS. 5-5D, a vehicle headlamp module 90 may include a plurality of optical elements 99 along the exit surface 98 of lens 91. Optical elements 99 are configured to shape the collimated light pattern 93 into a particular shape depending on the application of headlamp module 90. For example, optical elements 99 can be configured to shape a light pattern suitable for use as a low-beam, vehicle headlamp, i.e., a wide pattern directed relatively close to the vehicle headlamp module 90. As another example, optical elements 99 can be configured to shape a light pattern 93 suitable for use as a high-beam, vehicle headlamp, i.e., a narrow pattern directed farther away from the vehicle than a low-beam headlamp. Still further, optical elements 99 can be configured within vehicle headlamp module 90 to shape a collimated light pattern 93 suitable for fog, low-beam, high-beam, static bending and/or daytime running lamp applications.

According to one aspect, vehicle headlamp module 90 can include a lens 91 having an input surface 96 that is canted by a canting angle 96*a* (see FIG. 5B). The canting angle 96*a* can be set from −20 to +20 degrees, preferably between −10 and +10 degrees, depending on the particular aesthetic and aerodynamic features of the vehicle front containing the headlamp modules 90. Further, the bezel 91*a* and/or exterior shape of the lens 91 can also be canted in a corresponding relationship to the canting angle 96*a* associated with the input surface 96. In contrast, the exit surface 98 and optical elements 99 are not canted relative to the canting angle 96*a*. As shown in FIG. 5B, the exit surface 98 and optical elements 99 remain substantially "true-to-grid" relative to the roadway driven by the vehicle containing the vehicle headlamp module 90. Unexpectedly, the light transmission of the vehicle headlamp module 90 is not substantially decreased by the degree of canting exemplified by the canting angle 96*a*.

An advantage of the vehicle headlamp module 90 with a canted configuration as depicted in FIG. 5B is that the exterior surfaces of the module 90 can be more efficiently integrated in vehicle front designs having an upward orientation without substantial losses in light transmission efficiency. For example, as shown in FIG. 5B, the input surface 96 of a vehicle headlamp module 90 is canted in a counter-clockwise, upward direction according to the canting angle 96*a*. As a result, such a headlamp module 90 could be configured on the driver side of a vehicle having a vehicle front design that sweeps in an upward direction from the vehicle forward to the vehicle rearward direction. Similarly, the headlamp module 90 depicted in FIG. 5B could also be employed on the passenger side of a vehicle having a vehicle front design that sweeps in a downward direction from the vehicle forward to the vehicle rearward direction. In some aspects, the input surface 96, the bezel 91*a* and/or the exterior shape of the lens 91 of the headlamp module 90 can be canted according to the canting angle 96*a* substantially consistent with the vehicle front design. In such cases, the canting angle 96*a* can be set at least in part based on the vehicle front design.

According to another aspect, vehicle headlamp module 90 can include a lens 91 having an exit surface 98 having a step-wise pattern 99*a* of optical elements 99 (see FIG. 5D). In particular, the step-wise pattern 99*a* of optical elements 99 can be defined at least in part by a sweep angle 99*b*. The sweep angle 99*b* can be set from −45 to +45 degrees, preferably between −30 and +30 degrees, depending on the particular aesthetic and aerodynamic features of the vehicle front containing the headlamp modules 90. As shown in FIG. 5D, an exemplary vehicle headlamp module is configured with a sweep angle of about +20 degrees. Further, the bezel 91*a* and/or exterior shape of the lens 91 can also be swept in a corresponding relationship to the sweep angle 99*b* associated with the exit surface 98 (see FIG. 5). In some aspects, the input surface 96 and LED light source 94 are not swept relative to the sweep angle 99*b*, e.g., as depicted in FIGS. 5C-5D. As also shown in FIGS. 5C-5D, the optical elements 99 can be arranged in step-wise pattern 99*a* according to the sweep angle 99*b*. Advantageously, the light transmission of the vehicle headlamp module 90 is not substantially decreased by the degree of sweeping exemplified by the sweep angle 99*b*.

An advantage of the vehicle headlamp module 90 with a swept configuration as depicted in FIGS. 5C-5D is that the exterior surfaces of the module 90 can be more efficiently integrated in vehicle front designs having a vehicle lateral and vehicle rearward-sweeping orientation without substantial losses in light transmission efficiency. For example, as shown in FIGS. 5C-5D, the exit surface 98 of a vehicle headlamp module 90 is swept in a counter-clockwise, rearward direction according to the sweep angle 99*b*. As a result, such a headlamp module 90 could be configured on the passenger side of a vehicle having a typical vehicle front design (e.g., in proximity to the hood of the vehicle) that sweeps in a rearward direction moving from a position toward the vehicle center to the side of the vehicle. It should also be understood that the vehicle headlamp module 90, according to some aspects as depicted in FIGS. 5-5D, can be configured with both swept and canted features given by sweep angle 99*b* and canting angle 96*a*, respectively.

Vehicle headlamp modules 90 can be optimized in view of the potential trade-offs between light transmission efficiency and degree of collimation. A design of lens 91 with a single near-field lens element 92 generally exhibits lower transmission efficiency (e.g., 50% or less). This is particularly the case for non-circular lens elements, such as the hexagonally-shaped, near-field lens elements 92 depicted in FIG. 5B. On the other hand, a single near-field lens element can very efficiently collimate incident light with a Lambertian character from an LED light source 94 down to approximately 3 degrees.

While a large degree of collimation is beneficial, particularly for high-beam headlamp applications, it can be advantageous to design lens 91 with a plurality of lens elements 92 to increase light transmission efficiency. Preferably, three or more near-field lens elements 92 are integrated within lens 91 to achieve light transmission efficiencies on the order of 65% or better with collimation levels down to 5 degrees or less. Nevertheless, certain applications do not require the degree of collimation necessary for a vehicular headlamp application. Fog lamp and daytime running light applications, for example, only require collimation from 6 to 8 degrees and less than 10 degrees, respectively. Accordingly, more near-field lens elements 92 can be configured within headlamp modules 90 when they are employed in these less-directional applications (i.e., fog and daytime running lamps) to further increase light transmission efficiency.

The vehicle headlamp module 90 that is depicted in exemplary form within FIGS. 5-5D is configured with a total of three near-field lens elements 92. Such a configuration is particularly effective at delivering high light transmission efficiency for collimated, vehicular headlamp light patterns 93 (e.g., low- and high-beam headlamp patterns that satisfy U.S. federal regulations) produced by modules 90 having a hexagonally-shaped exit surface 98. In certain headlamp module configurations having rectangular, elliptical or hexagonal exit surfaces 98 with high aspect ratios, the number of near-field lens elements 92 can range from 3 to about 10 near-field elements. Accordingly, the plurality of near-field element 92 can include 3, 4, 5, 6, 7, 8, 9 or 10 near-field elements. Even higher numbers of near-field lens elements can be employed in the plurality of near-field elements 92 to improve light transmission efficiency, but current manufacturing techniques for the lens 91, depending on the material chosen for the lens, can limit the upper end of this range.

The use of a plurality of near-field lens elements 92 in vehicle headlamp modules 90 provides a large degree of design flexibility, particularly for low-profile configurations. Vehicle headlamp modules having lenses with non-circularly shaped exit surfaces, such as the hexagonally-shaped exit surfaces 98 and bezel 91*a* depicted in FIGS. 5 and 5B, generally suffer from a significant loss in transmission efficiency. Here, the use of multiple near-field lens elements 92 integrated within the lens 91 (often with varying focal lengths) significantly improves the light transmission efficiency of the headlamp modules 90 without a significant sacrifice to the degree of collimation needed for the application, such as vehicular headlamp applications. Consequently, low-profile designs of modules 90 (i.e., low aspect ratios of height to width) are feasible.

Still further, the use of a single-piece design for lens 91 with integrated lens elements 92, and the bezel 91*a* in some implementations, results in headlamp modules 90 having shorter depth profiles (i.e., as defined by the distance between the exit surfaces 98 and the input surfaces 96, or the LED light source 94). LED light sources 94 need only be mounted in a recessed portion of lens 91, not separated from input surfaces 96 by any additional components. In preferred configurations of vehicle headlamp modules 90, the depth profile is approximately 50 mm or less from the exit surfaces 98 to the LED light sources 94; the width of the module is approximately 80 to 90 mm and the height of the module is approximately 40 to 45 mm. Even more preferably, the depth profile of modules 90 is approximately 25 mm or less; the width is approximately 80 to 90 mm and the height is approximately 20 to 25 mm. It should be understood, however, that other low profile configurations for headlamp modules 90 are viable with dimensions that vary from the foregoing exemplary configuration.

Figure 6:
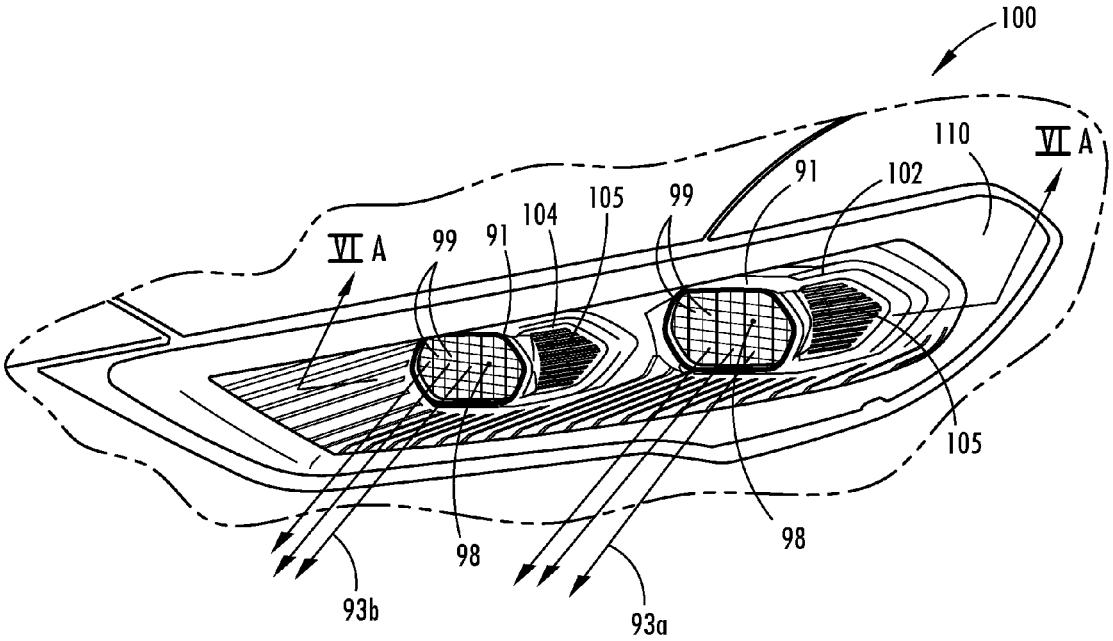
FIG. 6 is a front, perspective view of a vehicle headlamp assembly on the driver side of a vehicle that includes a pair of vehicle lighting modules with substantially hexagonal exit surfaces according to another aspect of this disclosure.
Figure 6A:
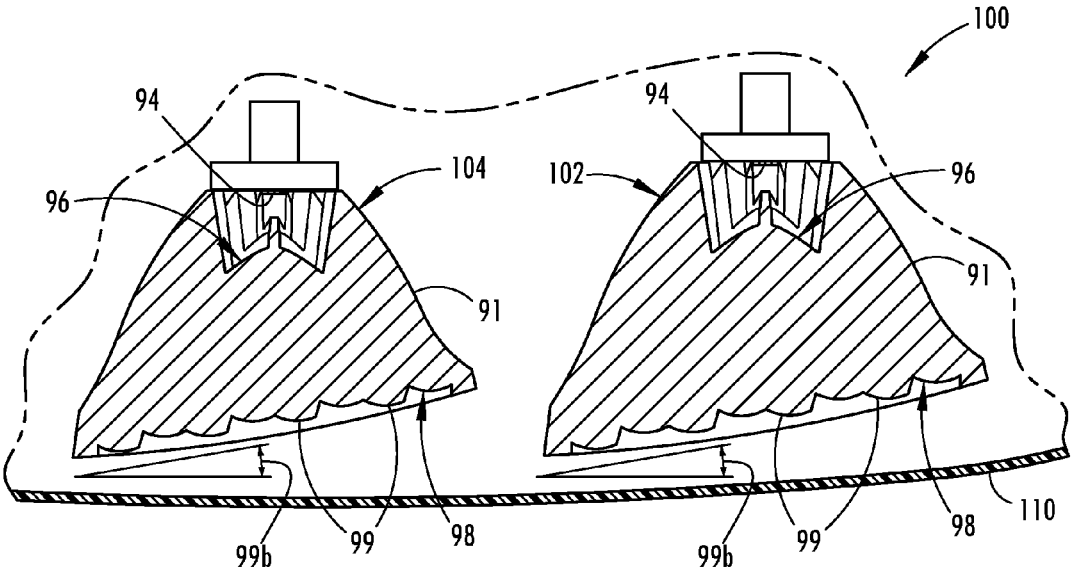
FIG. 6A is a cross-sectional view of the vehicle headlamp assembly depicted in FIG. 6 at line VIA-VIA.

Referring to FIGS. 6-6A, a vehicle headlamp assembly 100 is depicted according to a further aspect of the invention with a pair of adjacent headlamp modules 102, 104, respectively. Modules 102, 104 may be configured within the assembly 100 according to vehicle headlamp modules 90 for low beam and high beam headlamp applications according to the foregoing description. Each module 102, 104 includes a lens 91, and an LED light source 94 that directs incident light from light source 94 through lens 91. In some aspects of the assembly 100, each module 102, 104 is configured with a heat sink 105 to dissipate thermal energy associated with the LED light source 94.

As also shown in FIGS. 6-6A, the exit surface 98 of the lens 91 associated with each of the vehicle headlamp modules 102, 104, respectively, is substantially hexagonal in shape, whereas the input surface 96 is substantially circular in shape. In addition, each lens 91 includes a plurality of near-field lens elements 92. In certain aspects, these near-field lens elements 92 are configured to transmit from the exit surface 98 of lens 91 a collimated light pattern 93 containing at least 60% of the incident light from LED light source 94. It should be understood that the low beam and high beam headlamp modules 102 and 104 employed by vehicle headlamp assembly 100 operate and can be configured in a fashion similar to the vehicle headlamp modules 90 depicted in FIGS. 5-5D (e.g., lens 91 may possess three near-field lens elements 92).

FIGS. 6-6A also depict vehicle headlamp assemblies 100 with vehicle headlamp modules 102, 104, respectively, that include a plurality of optical elements 99 along the exit surface 98 of lens 91. Optical elements 99 associated with the modules 102, 104, respectively, can be configured in some embodiments to shape the light patterns 93*a*, 93*b* into low-beam and high-beam headlamp patterns, respectively. In other embodiments, optical elements 99 can be configured within vehicle headlamp modules 102, 104 to shape light patterns 93*a*, 93*b*, respectively, into light patterns suitable for fog, low-beam, high-beam, static bending and/or daytime running lamp applications. Preferably, these vehicle headlamp assemblies 100 are configured within a case 110 that is dimensioned, and the modules 102, 104 configured, such that the height-to-width aspect ratio of the case 110 is approximately 1:8. Even more preferably, the height-to-width ratio of the case 110 is approximately 1:4. In addition, the headlamp assemblies 100 may be configured with a case 110 that has the following principal dimensions: a height of approximately 20 to 55 mm; a width of approximately 150 to 200 mm; and a depth of approximately 20 to 55 mm.

Referring again to FIGS. 6-6A, the vehicle headlamp assembly 100, and its vehicle headlamp modules 102, 104, can be efficiently integrated according to the aesthetic and/or aerodynamic features of the vehicle (not shown) containing the assembly 100. As shown in exemplary form in FIGS. 6-6A, the vehicle headlamp assembly 100 is configured to contain low- and high-beam vehicle headlamp modules 102, 104, respectively, and is generally oriented on the driver side of the vehicle. Each of the headlamp modules 102, 104 is arranged with a lens 91 having exit surfaces 98 that individually possess a sweep angle 99*b* that generally corresponds to the sweep and curvature exhibited by the assembly 100 as mounted within the vehicle. While not shown in FIGS. 6-6A, each of the vehicle headlamp modules 102, 104 mounted within the assembly 100 can possess a lens 91 having input surface 96 that are canted according to a canting angle 96*a*. As such, the canting and sweeping configurational aspects of the modules 102, 104 facilitate a design for headlamp assembly 100 that advantageously fits within the aerodynamic and/or aesthetic aspects of the vehicle frontal design, without appreciable sacrifice in light transmission efficiency or collimation.

Variations and modifications can be made to the aforementioned structure without departing from the concepts of the present invention. Further, such concepts are intended to be covered by the following claims unless these claims by their language expressly state otherwise.

What is claimed is:

1. A vehicle headlamp module, comprising:

a lens having canted input surface including a plurality of near-field lens elements, an exit surface and a cavity between the surfaces; and an LED light source positioned to direct incident light through the input surface, wherein the elements are configured to shape the light from the input surface into a collimated light pattern emanating from the exit surface containing at least 60% of the incident light.

2. The vehicle headlamp module according to claim 1, wherein the plurality of near-field lens elements are three, near-field lens elements, each element having a different focal length.

3. The vehicle headlamp module according to claim 1, wherein the light source and the exit surface of the lens collectively define a depth of approximately 50 millimeters or less.

4. The vehicle headlamp module according to claim 1, wherein the light source and the exit surface of the lens collectively define a depth of approximately 25 millimeters or less.

5. The vehicle headlamp module according to claim 1, wherein the exit surface of the lens is arranged in a substantially hexagonal shape.

6. The vehicle headlamp module according to claim 1, wherein the exit surface of the lens comprises a plurality of optical elements configured to shape the collimated light pattern into a low-beam light pattern.

7. The vehicle headlamp module according to claim 1, wherein the exit surface of the lens comprises a plurality of optical elements configured to shape the collimated light pattern into a high-beam light pattern.

8. A vehicle headlamp module, comprising:

a lens having an input surface including a plurality of near-field lens elements, and an exit surface having a step-wise pattern of optical elements; and an LED light source positioned to direct incident light through the input surface, wherein the elements are configured to shape the light from the input surface into a collimated light pattern emanating from the exit surface containing at least 60% of the incident light.

9. The vehicle headlamp module according to claim 8, wherein the plurality of near-field lens elements are three, near-field lens elements, each element having a different focal length.

10. The vehicle headlamp module according to claim 8, wherein the light source and the exit surface of the lens collectively define a depth of approximately 50 millimeters or less.

11. The vehicle headlamp module according to claim 8, wherein the light source and the exit surface of the lens collectively define a depth of approximately 25 millimeters or less.

12. The vehicle headlamp module according to claim 8, wherein the exit surface of the lens is arranged in a substantially hexagonal shape.

13. The vehicle headlamp module according to claim 8, wherein the step-wise pattern of optical elements is configured to shape the collimated light pattern into a low-beam light pattern.

14. The vehicle headlamp module according to claim 8, wherein the step-wise pattern of optical elements is configured to shape the collimated light pattern into a high-beam light pattern.

15. A vehicle headlamp assembly, comprising:

a plurality of vehicle headlamp modules, each module comprising:

a lens with a canted input surface and an exit surface;

a bezel surrounding the lens; and an LED light source positioned to direct incident light through the input surface, wherein the input surface comprises a plurality of near-field lens elements for shaping at least 60% of the incident light into a collimated, vehicular light pattern emanating from the exit surface.

16. The vehicle headlamp assembly according to claim 15, wherein the plurality of vehicle headlamp modules comprises a low-beam headlamp module and a high-beam headlamp module.

17. The vehicle headlamp assembly according to claim 16, wherein the exit surface of the lens comprises a plurality of optical elements configured to shape the collimated light pattern into a low-beam or high-beam light pattern.

18. The vehicle headlamp assembly according to claim 17, wherein the plurality of optical elements is configured in a step-wise pattern.

19. The vehicle headlamp assembly according to claim 15, wherein the plurality of vehicle headlamp modules are mounted within a vehicle having a vehicle front design that sweeps in an upward direction from the vehicle forward to the vehicle rearward direction.

20. The vehicle headlamp assembly according to claim 19, wherein the canted input surface of the lens of each module is canted relative to the exit surface and to a degree based at least in part on the vehicle front design.

* * * * *